US005733665A

United States Patent [19]

Arimura et al.

[11] Patent Number: 5,733,665

[45] Date of Patent: Mar. 31, 1998

[54] MULTI-USABLE THERMAL TRANSFER INK SHEET

[75] Inventors: Takao Arimura; Masao Saisho; Jun Sogabe; Katsuhiro Yoshida; Naohiro Ikeda, all of Osaka, Japan

[73] Assignee: Fujicopian Co., Ltd., Osaka, Japan

[21] Appl. No.: 974,622

[22] Filed: Nov. 12, 1992

[30] Foreign Application Priority Data

Nov. 15, 1991 [JP] Japan ..... 3-300574

[51] Int. Cl.[6] ..... B41M 5/26

[52] U.S. Cl. ..... 428/484; 428/195; 428/207; 428/488.1; 428/913; 428/914

[58] Field of Search ..... 428/195, 484, 428/488.1, 913, 914, 408, 207

[56] References Cited

U.S. PATENT DOCUMENTS 4,927,693 5/1990 Koshizuka et al. ..... 428/488.1

FOREIGN PATENT DOCUMENTS 354293 2/1990 European Pat. Off. .
411924 2/1991 European Pat. Off. .
453257 10/1991 European Pat. Off. .
63-041577 2/1988 Japan .
2-277691 11/1990 Japan .

*Primary Examiner*—Pamela R. Schwartz
*Attorney, Agent, or Firm*—Armstrong, Westerman, Hattori, McLeland& Naughton

[57] ABSTRACT

A multi-usable thermal transfer ink sheet including a foundation and a multi-transferable ink layer provided on the foundation, the ink layer containing a heat-meltable material and carbon black as main ingredients, the carbon black having an oil absorption of not more than 70 ml/100 g. The ink sheet enables multi-printing with ensuring a high print density.

7 Claims, No Drawings

MULTI-USABLE THERMAL TRANSFER INK SHEET

BACKGROUND OF THE INVENTION

The present invention relates to a multi-usable thermal transfer ink sheet. More particularly, it relates to a multi-usable thermal transfer ink sheet constructed so that a heat-meltable ink layer is transferred in increments relative to the thickness thereof onto a receiving medium at every time when the same portion of the ink layer is heated by means of a heating means such as a thermal head.

This type of thermal transfer ink sheet which has been proposed heretofore includes one having a multi-transferable, heat-meltable ink layer containing 30 to 60 parts by weight of a heat-meltable resin, 10 to 40 parts by weight of a wax-like substance and 30 to 60 parts by weight of a coloring agent as the essential ingredients (see JP,A,2-277691). Generally carbon black is used as a coloring agent. The carbon black has not only the function of a coloring agent but also the function of adjusting the cohesive failure of the ink layer in a state of being heated for transfer, thereby transferring the ink layer in increments to enable multi-printing.

In the case of performing multi-printing with such a type of multi-usable thermal transfer ink sheet, printing must be able to be conducted many times with ensuring print images having a density of not less than a given value every time. However, there were no conventional multi-usable thermal transfer ink sheets which satisfied both requirements.

It is an object of the present invention to provide a multi-usable thermal transfer ink sheet which enables multi-printing with a high print density.

This and other objects of the present invention will become apparent from the description hereinafter.

SUMMARY OF THE INVENTION

The present invention provides a multi-usable thermal transfer ink sheet comprising a foundation and a multi-transferable ink layer provided on the foundation, the ink layer comprising a heat-meltable material and carbon black as main ingredients, the carbon black having an oil absorption of not more than 70 ml/100 g.

Herein, the value of the oil absorption is a measurement obtained by a test method provided in DIN 53601 using dibutyl phthalate as an oil.

DETAILED DESCRIPTION

In the present invention, printing can be performed many times with ensuring print images having a high density by using a multi-transferable ink layer containing carbon black having an oil absorption of not more than 70 ml/100 g.

It is necessary to reduce the amount of the ink layer transferred at one time in order to accomplish multi-printing using such type of multi-usable thermal transfer ink sheet. In that case, the content of carbon black as a coloring agent must be increased in order to ensure a print density of not less than a given value. However, when the content of carbon black is increased, the flowability of the ink required for thermal transfer is not ensured, and as a result, there occurs a problem that contrary to expectation, the print density is lowered or printing cannot be conducted many times. With respect to the multi-transferable ink layer, there are such mutually contradictory requirements.

In the present invention, however, there has been discovered an unexpected fact that when one having an oil absorption of not more than 70 ml/100 g is used as carbon black, the flowability of the ink required for thermal transfer can be ensured even with a high content of carbon black, and therefore the content of carbon black can be increased and printing can be conducted many times with a high print density.

Any available carbon black can be used regardless of the type thereof, provided that it has an oil absorption of not more than 70 ml/100 g, preferably not more than 55 ml/100 g. With respect to the oil absorption of carbon black which is commercially available at present, the maximum value is approximately 500 ml/100 g and the minimum value is approximately 40 ml/100 g.

Any conventional ink composition for attaining multi-printing can be used for the multi-transferable ink layer used in the present invention, except that the carbon black used is the above-specified one. In principle, the ink layer of the present invention is composed of carbon black and a heat-meltable material.

The content of carbon black in the ink layer is preferably from 30 to 60% by weight, more preferably from 40 to 60% by weight. When the content of carbon black is less than the above range, the cohesive failure of the ink layer is hard to occur, so that multi-printing becomes difficult. When the content of carbon black is more than the above range, the ink layer becomes brittle and the thermal transfer sensitivity is lowered, so that multi-printing becomes difficult.

Usually a mixture of a heat-meltable resin and a wax-like substance is used as the heat-meltable material.

The heat-meltable resin serves to impart to the ink layer a proper cohesive force required for multi-printing and the wax-like substance serves to adjust the cohesive failure of the ink by lowering the cohesive force of the resin.

Examples of the heat-meltable resin include ethylene copolymers such as ethylene-vinyl acetate copolymer, ethylene-vinyl butyrate copolymer, ethylene-(meth)acrylic acid copolymer, ethylene-alkyl (meth)-acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polydodecyl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters such as sebacic acid-decanediol polymer, azelaic acid-dodecanediol polymer and azelaic acid-hexadecanediol polymer; and polyamides. These resins may be used singly or in combination. From the viewpoint of thermal transfer sensitivity, the preferred heat-meltable resins are those having a melting or softening temperature of 40° to 140° C. (value measured by DSC, hereinafter the same).

Examples of the wax-like substances include natural waxes such as haze wax, bees wax, carnauba wax, candelilla wax, montan wax and ceresine wax; petroleum waxes such as paraffin wax and microcrystalline wax; synthetic waxes such as oxidized wax, ester wax, low molecular weight polyethylene, α-olefin wax and Fischer-Tropsch wax; higher fatty acids such as myristic acid, palmille acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These wax-like substances may be used singly or in combination. From the viewpoint of thermal transfer sensitivity, the preferred wax-like substances are those having a melting temperature of 40° to 120° C.

The ratio of the heat-meltable resin to the wax-like substance is preferably 1:0.2 to 4, more preferably 1:0.3 to 3. When the proportion of the wax-like substance is more than the above range, the cohesive force of the ink becomes too small and therefore the amount of the ink transferred at one time becomes large, so that multi-printing becomes difficult. When the proportion of the wax-like substance is less than the above range, the cohesive failure of the ink layer is hard to occur, so that multi-printing becomes difficult.

The content of the heat-meltable material, i.e. the mixture of the heat-meltable resin and the wax-like substance, in the ink layer is suitably from 40 to 70% by weight.

According to the present invention, a non-volatile liquid substance may be further incorporated into the multi-transferable ink layer. The liquid substance has the function of more properly adjusting the cohesive failure of the ink to improve the thermal transferability.

Examples of the liquid substances include natural oils and derivatives thereof such as rapeseed oil, castor oil, coconut oil, sunflower oil, corn oil, Meadow foam oil, linseed oil, safflower oil, lanolin and its derivatives, fish oils, squalane and jojoba oil, mink oil and horse oil; petroleum oils such as liquid paraffin, petrolatum, spindle oil and motor oil; surface active agents such as sorbitan oleate, polyoxyethylene fatty acid esters, polyoxyethylene alkylphenyl ethers and polyoxyethylene alkyl ethers; plasticizers such as dioctyl phthalate, tributyl acetylcitrate, dioctyl azelate, dioctyl sebacate, diethyl phthalate and dibutyl phthalate; and fatty acids such as oleic acid, lauric acid, linoleic acid, linolenic acid and isostearic acid. These liquid substances may be used singly or in combination.

The liquid substance is preferably incorporated into the ink layer in a content of 0 to 50% by weight, more preferably 5 to 20% by weight. When the content of the liquid substance is more than the above range, the cohesive force of the ink layer becomes too small and therefore the amount of the ink transferred at one time becomes large, so that multi-printing becomes difficult.

The multi-transferable ink layer may contain a dispersing agent for improving the dispersibility of carbon black, a filler such as diatomaceous earth, talc, silica powder or calcium carbonate, or other additives in addition to the above-mentioned ingredients, as necessary.

From the viewpoint of obtaining good multi-printing property and thermal transfer sensitivity, the multi-transferable ink layer in the present invention is adjusted to preferably have a melting or softening temperature of 40° to 100° C. and a melt viscosity of 500 to 50,000 poises/100° C., especially 6,000 to 20,000 poises/100° C. (value measured with Soliquid Meter MR-300 made by Rheology Co., Ltd.)

The multi-transferable ink layer can be formed by applying to a foundation a coating liquid which is prepared by dissolving or dispersing the above-mentioned ingredients into an appropriate organic solvent, or another coating liquid in the form of an aqueous dispersion, an emulsion or the like, by means of an appropriate coating means such as roll coater, gravure coater, reverse coater or bar coater, followed by drying. The multi-transferable ink layer may also be formed by a hot-melt coating.

The dry coating weight of the multi-transferable ink layer is preferably from about 6 to about 12 g/m$^2$ from the viewpoint of ensuring the desired multi-printing property.

A variety of plastic films commonly used as a foundation film for this type of ink sheet, including polyester films such as polyethylene terephthalate film and polyethylene naphthalate film, polyamide film, aramid film, and the like, can be used as the foundation in the present invention. In the case of using such plastic films, there is preferably provided on the rear surface of the foundation (the surface in sliding contact with a heating head) a conventional stick-preventing layer composed of one or more of various lubricative heat-resistant resins such as silicone resin, fluorine-containing resin and nitrocellulose, other resins modified with the foregoing lubricative heat resistant resins, and mixtures of the foregoing resins with lubricating agents, in order to prevent the foundation from sticking to the heating head. Antistatic agent and other additives may be contained in the foundation and/or the stick-preventing layer. High density thin papers such as condenser paper can also be used as the foundation. The thickness of the foundation is preferably from about 1 to about 9 μm, more preferably from about 2 to about 6 μm from the viewpoint of ensuring good heat conduction.

The present invention is more specifically described and explained by means of the following Examples. It is to be understood that the present invention is not limited to the Examples, and various change and modifications may be made in the invention without departing from the spirit and scope thereof.

EXAMPLES 1 TO 4 AND COMPARATIVE EXAMPLES 1 to 2

Onto the front surface of a polyester film having a thickness of 4.5 μm provided with a stick-preventing layer having a dry coating amount of 0.1 g/m$^2$ composed of a silicone-modified urethane resin on the rear surface thereof was applied each coating liquid in a coating amount of 9 g/m$^2$ after drying, which coating liquid was prepared by dissolving or dispersing each composition shown in Table 1 into a mixed solvent of benzene-ethyl acetate, followed by drying to form a multi-transferable ink layer having the physical properties shown in Table 1, thus yielding a thermal transfer ink sheet.

Each of the thermal transfer ink sheets obtained above was subjected to a printing test using a thermal printer (PCPR printer made by NEC Corporation). Paper having a Bekk smoothness of 300 seconds was used as a receiving paper. The results are shown in Table 2.

TABLE 1

| | Ex. 1 | Ex. 2 | Ex. 3 | Ex. 4 | Com. Ex. 1 | Com. Ex. 2 |
|---|---|---|---|---|---|---|
| Ink composition (% by weight) | | | | | | |
| EVA*[1] (softening temp. 50° C., MI 400) | 30 | 30 | 30 | 30 | 30 | 30 |
| Paraffin wax (m.p. 63° C.) | 15 | 15 | 25 | 14 | 15 | 15 |
| Lanolin | 9 | 9 | 9 | — | 9 | 9 |

TABLE 1-continued

| | Ex. 1 | Ex. 2 | Ex. 3 | Ex. 4 | Com. Ex. 1 | Com. Ex. 2 |
|---|---|---|---|---|---|---|
| Homogenol (dispersing agent made by Kao Corporation) | 1 | 1 | 1 | 1 | 1 | 1 |
| Carbon black A (OA*2 46 ml/100 g) | 45 | — | 35 | 55 | — | — |
| Carbon black B (OA 65 ml/100 g) | — | 45 | — | — | — | — |
| Carbon black C (OA 76 ml/100 g) | — | — | — | — | 45 | — |
| Carbon black D (OA 114 ml/100 g) | — | — | — | — | — | 45 |
| Physical property | | | | | | |
| Melt viscosity (poise/100° C.) | 8,500 | 11,000 | 5,000 | 14,000 | 12,500 | 13,500 |
| Softening temp. (°C.) | 56 | 56 | 60 | 61 | 55 | 57 |

*1EVA = ethylene-vinyl acetate copolymer
*2OA = oil absorption

TABLE 2

| Print density (OD) | Ex. 1 | Ex. 2 | Ex. 3 | Ex. 4 | Com. Ex. 1 | Com Ex. 2 |
|---|---|---|---|---|---|---|
| 1st printing | 1.35 | 1.12 | 1.37 | 1.04 | 1.06 | 0.81 |
| 2nd printing | 1.31 | 1.15 | 1.21 | 1.15 | 0.94 | 0.75 |
| 3rd printing | 1.20 | 1.11 | 1.00 | 1.03 | 0.91 | 0.68 |
| 4th printing | 1.21 | 1.10 | 0.87 | 1.03 | 0.84 | 0.69 |

As is clear from comparison of Examples 1 to 2 with Comparative Examples 1 to 2, the use of carbon black having an oil absorption of not more than 70 ml/100 g (Examples 1 to 2) gave print images having a density (OD) of not less than 1.0 four times, while the use of carbon black having an oil absorption of more than 70 ml/100 g with the same content (Comparative Examples 1 to 2) gave print images having a density of not less than 1.0 only one time (Comparative Example 1) or no print images having a density of not less than 1.0 (Comparative Example 2).

EXAMPLES 5 TO 7

The same procedures as in Examples 1 to 4 except that the ink composition was changed to those shown in Table 3 were repeated to give thermal transfer ink sheets.

The thermal transfer ink sheets obtained were subjected to the same test as in Examples 1 to 4. The results are shown in Table 3.

TABLE 3

| | Ex. 5 | Ex. 6 | Ex. 7 |
|---|---|---|---|
| Ink composition (% by weight) | | | |
| Vylon 300*1 | 30 | — | — |
| EVA (softening temp. 40° C., MI 400) | — | 30 | 13 |
| Ester wax (m.p. 80° C.) | 15 | 9 | 26 |
| Paraffin wax (m.p. 63° C.) | — | 15 | — |
| Liquid paraffin | 9 | — | 15 |
| Homogenol (dispersing agent made by Kao Corporation) | 1 | 1 | 1 |
| Carbon black A (OA 46 ml/100 g) | 45 | 45 | 45 |
| Physical property | | | |
| Melt viscosity (poise/100° C.) | 9,600 | 7,900 | 1,900 |
| Softening temp. (°C.) | 67 | 60 | 69 |
| Print density (OD) | | | |
| 1st printing | 1.15 | 1.23 | 1.31 |
| 2nd printing | 1.11 | 1.25 | 1.32 |

TABLE 3-continued

| | Ex. 5 | Ex. 6 | Ex. 7 |
|---|---|---|---|
| 3rd printing | 1.08 | 1.17 | 1.00 |
| 4th printing | 1.05 | 1.16 | 0.87 |

*1: Polyester resin made by Toyobo Co., Ltd., softening temp. 123° C., melt viscosity 800 poises/200° C.

In addition to the materials and ingredients used in the Examples, other materials and ingredients can be used in the Examples as set forth in the specification to obtain substantially the same results.

What we claim is:

1. A multi-usable thermal transfer ink sheet comprising a foundation and a multi-transferable ink layer provided on the foundation, the ink layer being an ink layer which is brought into contact with a receiving medium during transfer and which is capable of being transferred in increments relative to the thickness thereof onto a receiving medium every time when the same portion of the ink layer is heated, the ink layer comprising a heat-meltable material and carbon black as main ingredients, the carbon black having an oil absorption of not more than 70 ml/100 g, wherein the content of the carbon black in the ink layer is from 40 to 60% by weight.

2. The multi-usable thermal transfer ink sheet of claim 1, wherein the heat-meltable material comprises a heat-meltable resin and a wax substance, the ratio of the heat-meltable resin to the wax substance being 1:0.2 to 4.

3. The multi-usable thermal transfer ink sheet of claim 1, wherein the oil absorption of the carbon black is not more than 55 ml/100 g.

4. The multi-usable thermal transfer ink sheet of claim 1, wherein the ink layer has a melt viscosity of 500 to 50,000 poises/100° C.

5. The multi-usable thermal transfer ink sheet of claim 4, wherein the melt viscosity of the ink layer is from 6,000 to 20,000 poises/100° C.

6. The multi-usable thermal transfer ink sheet of claim 1, wherein the content of the carbon black in the ink layer is from 40 to 60% by weight, and the ink layer has a melt viscosity of 500 to 50,000 poises/100° C.

7. The multi-usable thermal transfer ink sheet of claim 1, wherein the oil absorption of the carbon black is not more than 55 ml/100 g, the content of the carbon black in the ink layer is from 40 to 60% by weight, and the ink layer has a melt viscosity of 6,000 to 20,000 poises/100° C.

* * * * *